US011761690B2

(12) United States Patent
Jang et al.

(10) Patent No.: US 11,761,690 B2
(45) Date of Patent: Sep. 19, 2023

(54) GAS HEAT-PUMP SYSTEM AND METHOD OF CONTROLLING SAME

(71) Applicant: LG ELECTRONICS INC., Seoul (KR)

(72) Inventors: Heejoong Jang, Seoul (KR); Hojong Jeong, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 173 days.

(21) Appl. No.: 17/123,549

(22) Filed: Dec. 16, 2020

(65) Prior Publication Data

US 2021/0180805 A1 Jun. 17, 2021

(30) Foreign Application Priority Data

Dec. 16, 2019 (KR) ..... 10-2019-0168124

(51) Int. Cl.
*F25B 27/02* (2006.01)
*F25B 29/00* (2006.01)
(Continued)

(52) U.S. Cl.
CPC ..... *F25B 27/02* (2013.01); *F25B 29/003* (2013.01); *F25B 30/02* (2013.01); *F25B 31/006* (2013.01); *F25B 40/02* (2013.01); *F25B 41/20* (2021.01); *F25B 41/26* (2021.01); *F25B 41/40* (2021.01); *F24F 2221/183* (2013.01); *F25B 2300/00* (2013.01); *F25B 2313/003* (2013.01); *F25B 2313/004* (2013.01); *F25B 2313/02741* (2013.01); *F25B 2327/00* (2013.01); *F25B 2339/047* (2013.01)

(58) Field of Classification Search
CPC ..... F24D 11/0228; F24D 11/0235; F24D 17/0047; F25B 27/02; F25B 29/003; F25B 2313/003; F25B 2313/004; F25B 2327/00; F25B 2327/001; F25B 2339/046
See application file for complete search history.

(56) References Cited

U.S. PATENT DOCUMENTS 2,950,607 A * 8/1960 Fries, Jr. ..... F25B 29/003 62/331
7,503,184 B2 * 3/2009 Copeland ..... F25B 27/02 62/238.7

(Continued)

*Primary Examiner* — Christopher R Zerphey
(74) *Attorney, Agent, or Firm* — KED & ASSOCIATES

(57) ABSTRACT

Proposed a gas heat-pump system including: a compressor compressing refrigerant and discharging the compressed refrigerant; an engine providing a drive force to the compressor; a radiator that cools coolant which is heated while passing through the engine; an indoor heat exchanger causing heat exchange to occur between indoor air and the refrigerant and thus cooling or heating an indoor space; an outdoor heat exchanger condensing the refrigerant; a four-way valve switching a flow direction of the refrigerant in such a manner that the refrigerant discharged from the compressor flows to the outdoor heat exchanger in a cooling operation mode and flows to the indoor heat exchanger in a heating operation mode; and a hot-water storage tank causing the heat exchange to occur between stored water and the refrigerant, and thus cooling the refrigerant in the cooling operation mode and heating the refrigerant in the heating operation mode.

6 Claims, 10 Drawing Sheets

(51) Int. Cl.

| | |
|---|---|
| ***F25B 30/02*** | (2006.01) |
| ***F25B 31/00*** | (2006.01) |
| ***F25B 40/02*** | (2006.01) |
| ***F25B 41/20*** | (2021.01) |
| ***F25B 41/26*** | (2021.01) |
| ***F25B 41/40*** | (2021.01) |

(56) References Cited

U.S. PATENT DOCUMENTS

| | | | | |
|---|---|---|---|---|
| 8,549,868 | B2 * | 10/2013 | Komori | F24D 3/08 62/238.7 |
| 9,759,449 | B2 * | 9/2017 | Ootani | F24H 1/18 |
| 9,797,605 | B2 * | 10/2017 | Tamaki | F24D 5/12 |
| 10,352,593 | B2 * | 7/2019 | Choi | F25B 43/006 |
| 11,268,737 | B2 * | 3/2022 | Matsuda | F25B 49/02 |
| 11,365,911 | B2 * | 6/2022 | Chung | F25B 27/02 |
| 2005/0028547 | A1 * | 2/2005 | Hatakeyama | B60H 1/00921 62/324.1 |
| 2010/0018228 | A1 * | 1/2010 | Flammang | F25B 27/02 62/238.7 |

* cited by examiner

GAS HEAT-PUMP SYSTEM AND METHOD OF CONTROLLING SAME

CROSS REFERENCE TO RELATED APPLICATION

The present application claims priority to Korean Patent Application No. 10-2019-0168124, filed Dec. 16, 2019, the entire contents of which is incorporated herein for all purposes by this reference.

BACKGROUND OF THE INVENTION

Field of the Invention

The present invention relates to a gas heat-pump system and a method of controlling the gas heat-pump system and, more particularly, to a gas heat-pump system and a method controlling the gas heat-pump system, which are capable of utilizing waste heat from refrigerant and coolant as much as possible and improving heating performance.

Description of the Related Art

A heat-pump system is a system that is capable of performing a cooling or heating operation through a refrigeration cycle, and operates in cooperation with a hot-water supply apparatus or a cooling and heating apparatus. That is, hot water is produced, or air conditioning for cooling and heating is performed using a heat source that is obtained as a result of heat exchange occurring between cooling refrigerant in the refrigeration cycle and a predetermined heat storage medium.

Generally, a configuration for the refrigeration cycle requires that a compressor compressing refrigerant, a condenser condensing the refrigerant compressed by the compressor, an expansion device decompressing the refrigerant condensed by the condenser, and an evaporator evaporating the decompressed refrigerant are included.

The heat-pump systems include a gas heat-pump system (GHP). High capacity compressors are required for industrial use or for air conditioning in large non-residential buildings. That is, the gas heat-pump system is used as a system that, instead of an electric motor, uses an electric motor to drive a compressor compressing a large amount of refrigerant into high-temperature, high-pressure gas.

The gas heat-pump system includes an engine generating a motive force using a mixture of fuel and gas (hereinafter referred to as "mixed gas"), an air supply device supplying the mixed gas to the engine, a fuel supply device, and a mixer mixing the air and the fuel.

The engine includes a cylinder to which the mixed gas is supplied and a piston provided to be movable within the cylinder. The air supply device includes an air filter purifying air. The fuel supply device includes a zero governor supplying fuel with predetermined pressure.

The gas heat-pump system includes coolant cooling the engine while circulating therethrough. The coolant absorbs waste heat occurring in the engine, and the absorbed waste heat is supplied to the refrigerant circulating through the gas heat-pump system, thereby improving performance thereof. Particularly, when a heating operation is performed by the gas heat-pump system, evaporation performance of the refrigeration cycle can be improved.

The waste heat can be continuously produced from the engine to a degree more than is necessary for the refrigeration cycle. However, a gas heat-pump system in the related art is not configured in such a manner that the waste occurring in the engine can be additionally utilized. For this reason, surplus waste heat occurring in the engine has been discharged to the surroundings.

The foregoing is intended merely to aid in the understanding of the background of the present disclosure, and is not intended to mean that the present disclosure falls within the purview of the related art that is already known to those skilled in the art.

SUMMARY OF THE INVENTION

An objective of the present disclosure is to provide a gas heat-pump system and a method of controlling the gas heat-pump system, which supplies waste heat recovered from refrigerant and coolant to a hot-water storage tank to heat water stored in the hot-water storage tank, and heats the refrigerant by utilizing high-temperature hot water stored in the hot-water storage tank, thus improving heating performance.

According to an aspect of the present disclosure, there is provided a gas heat-pump system including: a compressor compressing refrigerant and discharging the compressed refrigerant; an engine providing a drive force to the compressor; a radiator that cools coolant which is heated while passing through the engine; an indoor heat exchanger causing heat exchange to occur between indoor air and the refrigerant and thus cooling or heating an indoor space; an outdoor heat exchanger condensing the refrigerant; a four-way valve switching a flow direction of the refrigerant in such a manner that the refrigerant discharged from the compressor flows to the outdoor heat exchanger in a cooling operation mode and flows to the indoor heat exchanger in a heating operation mode; and a hot-water storage tank causing the heat exchange to occur between stored water and the refrigerant, and thus cooling the refrigerant in the cooling operation mode and heating the refrigerant in the heating operation mode.

In the gas heat-pump system, in the cooling operation mode, the hot-water storage tank may cause the heat exchange to occur between the coolant passing through the engine and the stored water and thus may cool the coolant.

The gas heat-pump system may further include: a hot-water storage tank refrigerant line, branching off from a main refrigerant line connecting the four-way valve and the outdoor heat exchanger to each other, passing through the hot-water storage tank for the heat exchange, and then being connected to the outdoor heat exchanger; and a first three-way valve switching the flow direction of the refrigerant in such a manner that the refrigerant passing through the four-way valve flows along the main refrigerant line or the hot-water storage tank refrigerant line.

The gas heat-pump system may further include: a hot-water storage tank coolant line, branching off from a main coolant line connecting the engine and the radiator to each other, passing through the hot-water storage tank for the heat exchange, and then being connected to the engine; and a second three-way valve switching a flow direction of the coolant in such a manner that the coolant passing through the engine flows along the main coolant line or the hot-water storage tank coolant line.

In the gas heat-pump system, the hot-water storage tank coolant line may be positioned above the hot-water storage tank refrigerant line within the hot-water storage tank.

The gas heat-pump system may further include: a branch refrigerant line branching off from the main refrigerant line connecting the indoor heat exchanger and the outdoor heat exchanger to each other, and being connected to the hot-water storage tank refrigerant line connecting the hot-water storage tank and the outdoor heat exchanger to each other; a three-way valve provided on a junction between of the branch refrigerant line and the hot-water storage tank refrigerant line, the three-way valve being configured to selectively connect the hot-water storage tank refrigerant line and the branch refrigerant line; and an on-off valve provided on the hot-water storage tank refrigerant line between the third three-way valve and the outdoor heat exchanger, the on-off valve being configured to open the hot-water storage tank refrigerant line in the cooling operation mode and close the hot-water storage tank refrigerant line in the heating operation mode.

In the gas heat-pump system, in the cooling operation mode, the third three-way valve may switches the flow direction of the refrigerant in such a manner that the refrigerant passes through the outdoor heat exchanger and then flows along the main refrigerant line or flows along the main refrigerant line through the branch refrigerant line.

The gas heat-pump system may further include: an auxiliary refrigerant line branching off from the main refrigerant line connecting the indoor heat exchanger and the outdoor heat exchanger to each other, passing through an auxiliary heat exchanger, and then being connected to the compressor; an auxiliary expansion valve opening and closing the auxiliary refrigerant line between the indoor heat exchanger and the auxiliary heat exchanger; an auxiliary coolant line branching off from the main coolant line connecting the engine and the second three-way valve, passing through the auxiliary heat exchanger, and then being connected to the engine; and a fourth three-way valve switching the flowing direction of the coolant in such a manner that the coolant passing through the engine flows along the main coolant line or the auxiliary coolant line.

The gas heat-pump system may further include; a heating line passing through an inside of the hot-water storage tank for the heat exchange with water stored in the hot-water storage tank; and a heating unit heating the water passing through the heating line.

In the gas heat-pump system, the heating line may be positioned below a hot-water storage tank refrigerant line within the hot-water storage tank.

According to another aspect of the present disclosure, there is provided a method of controlling a gas heat-pump system in a cooling operation mode, the system including: a first refrigerant circulation path along which a refrigerant that is discharged from a compressor compressing the refrigerant using a drive force of an engine is cooled in an outdoor heat exchanger, passes through an indoor heat exchanger, and then circulates to the compressor; a second refrigerant circulation path along which the refrigerant discharged from the compressor is cooled in a hot-water storage tank and then in the outdoor heat exchanger, passes through the indoor heat exchanger, and then circulates to the compressor; a first coolant circulation path along which coolant cooling an engine is cooled in a radiator and then circulates to the engine; and a second coolant circulation path along which the coolant cooling the engine is cooled in the hot-water storage tank and then circulates to the engine.

The method includes: determining whether or not water stored in the hot-water storage tank is in use as hot water; measuring temperature of the water stored in the hot-water storage tank and thus determining an amount of the hot water in use when the water stored in the hot-water storage tank is in use as the hot water; and determining paths along which the refrigerant and the coolant circulate in a manner that corresponds to whether or not the water stored in the hot-water storage tank is in use as the hot water or the amount of the hot water in use.

In the method, in the determining of the paths along which the refrigerant and the coolant circulate, when it is determined that the water stored in the hot-water storage tank is not in use as the hot water, control may be performed in such a manner that the refrigerant flows along the first refrigerant circulation path and that the coolant flows along the first coolant circulation path.

In the method, in the determining of the paths along which the refrigerant and the coolant circulate, when the amount of the hot water in use falls short of being within a predetermined range, control may be performed in such a manner that the refrigerant flows along the second refrigerant circulation path and that the coolant flows along the first coolant circulation path.

In the method, in the determining of the paths along which the refrigerant and the coolant circulate, when the amount of the hot water in use falls within the predetermined range, control may be performed in such a manner that the refrigerant flows along the second refrigerant circulation path and that the coolant flows along the second coolant circulation path.

In the method, in the determining of the paths along which the refrigerant and the coolant circulate, when the amount of the hot water in use exceeds the predetermined range, control may be performed in such a manner that the refrigerant flows along the second refrigerant circulation path and that the coolant flows along the second coolant circulation path, and a water heating operation of heating the water stored in the hot-water storage tank may be performed by operating a heating unit connected to the hot-water storage tank through a heating line.

In the method, the gas heat-pump system may further include; a third refrigerant circulation path along which the refrigerant discharged from the compressor is cooled in the hot-water storage tank, bypasses the indoor heat exchanger, and then circulates to the compressor, and in the determining of the paths along which the refrigerant and the coolant circulate, when the amount of the hot water in use falls within the predetermined range, control may be performed in such a manner that the refrigerant flows along the third refrigerant circulation path and that the coolant flows along the second coolant circulation path.

According to still another aspect of the present disclosure, there is a method of controlling a gas heat-pump system in a heating operation mode, the system including: a first refrigerant circulation path along which a refrigerant that is discharged from a compressor compressing the refrigerant using a drive force of an engine exchanges heat in an indoor heat exchange, is heated in an auxiliary heat exchanger, and then circulates to the compressor; a second refrigerant circulation path along which the refrigerant discharged from the compressor exchanges heat in the indoor heat exchanger is heated in a hot-water storage tank, and then circulates to the compressor; and a coolant circulation path along which a coolant cooling an engine is cooled in the auxiliary heat exchanger, and then circulates to the engine.

The method includes: determining whether or not a water heating operation of operating a heating unit to heat water stored in the hot-water storage tank for use as hot water is performed; determining heating performance, depending on whether or not the water heating operation is performed in a manner that satisfies a preset heating condition; and determining a path along which the refrigerant circulates in a manner that corresponds to whether or not the water heating operation is performed and the heating performance.

In the method, in the determining of the path along which the refrigerant circulates, when it is determined that the water heating operation is not performed, control may be performed in such a manner that the refrigerant flows along the first refrigerant circulation path.

In the method, in the determining of the path along which the refrigerant circulates, when the water heating operation is performed and the heating performance does not satisfy the preset heating condition, control may be performed in such a manner that the refrigerant flows along both the first refrigerant circulation path and the second refrigerant circulation path.

In the method, in the determining of the heating performance, it may be determined whether or not temperature of air discharged from the indoor heat exchanger is a target temperature that satisfies the reset heating condition.

With the gas heat-pump system and the method of controlling the gas heat-pump system according to the present disclosure, when a cooling operation is performed, waste heat recovered from the refrigerant and the coolant is supplied to the hot-water storage tank to heat the water stored in the hot-water storage tank. Thus, the advantage of saving energy can be achieved.

Furthermore, according to the present disclosure, when a heating operation is performed, the refrigerant is heated by utilizing high-temperature hot water stored in the hot-water storage tank. Thus, the advantage of improving heating performance can be achieved.

BRIEF DESCRIPTION OF THE DRAWINGS

The above and other objectives, features, and other advantages of the present disclosure will be more clearly understood from the following detailed description when taken in conjunction with the accompanying drawings, in which.

DETAILED DESCRIPTION OF THE INVENTION

Figure 1:
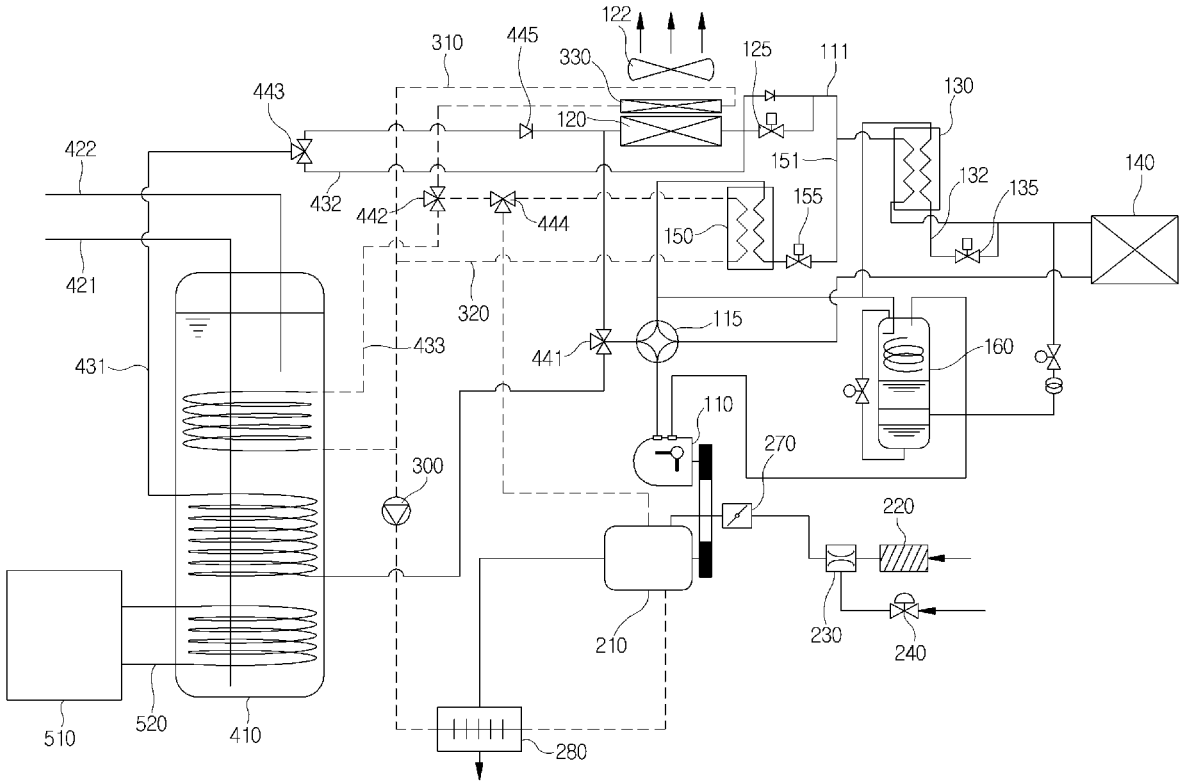
FIG. 1 is a view schematically illustrating a gas heat-pump system according to the present disclosure.

A gas heat-pump system and methods of controlling the gas heat-pump system according to the present disclosure will be described in more detail below to provide an understanding of features of the present disclosure.

It is noted that, if possible, the same constituent elements are given the same reference character throughout the accompanying drawings that are referred to for illustration and may be in use as an aid in describing the embodiments. In addition, specific descriptions of well-known configurations and functions associated with the present disclosure will be omitted when determined as making the nature and gist of the present disclosure unclear.

Specific embodiments of the present disclosure will be described below with reference to the accompanying drawings.

FIG. 1 is a view schematically illustrating a gas heat-pump system according to the present disclosure.

Figure 7:
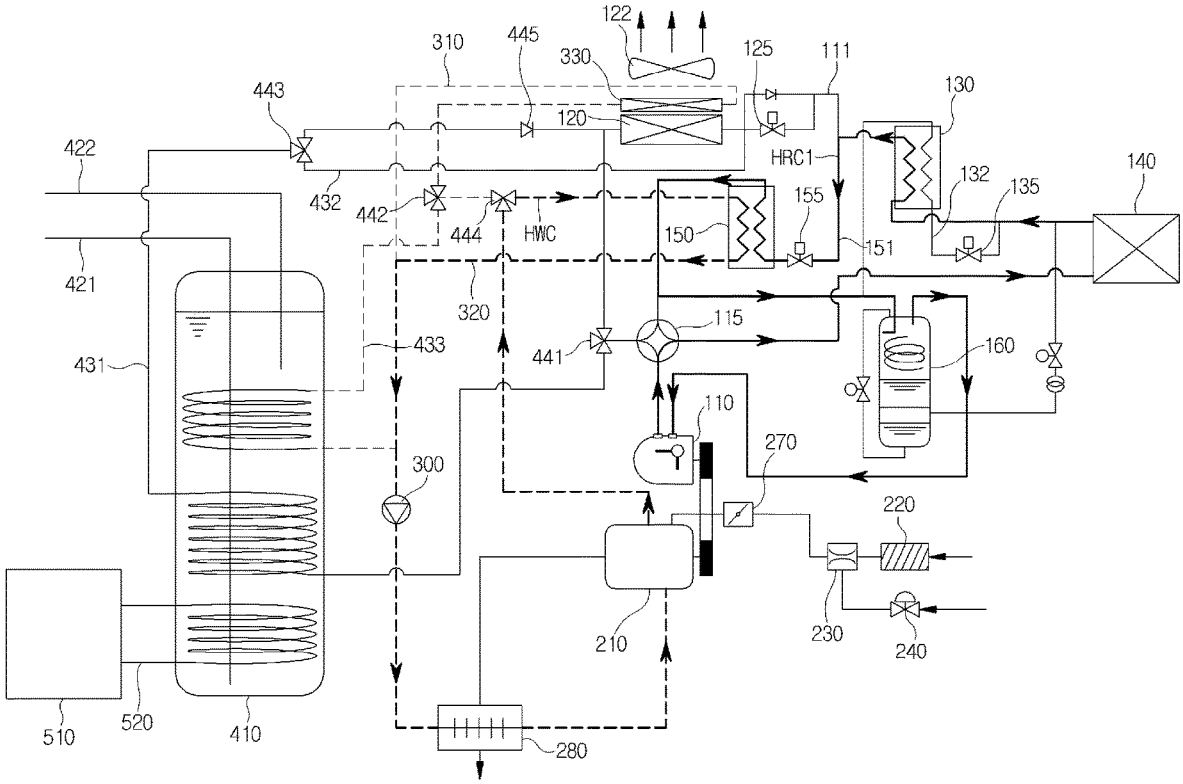
FIG. 7 is a view schematically illustrating the gas heat-pump system in a heating operation mode according to the first embodiment of the present disclosure.
Figure 8:
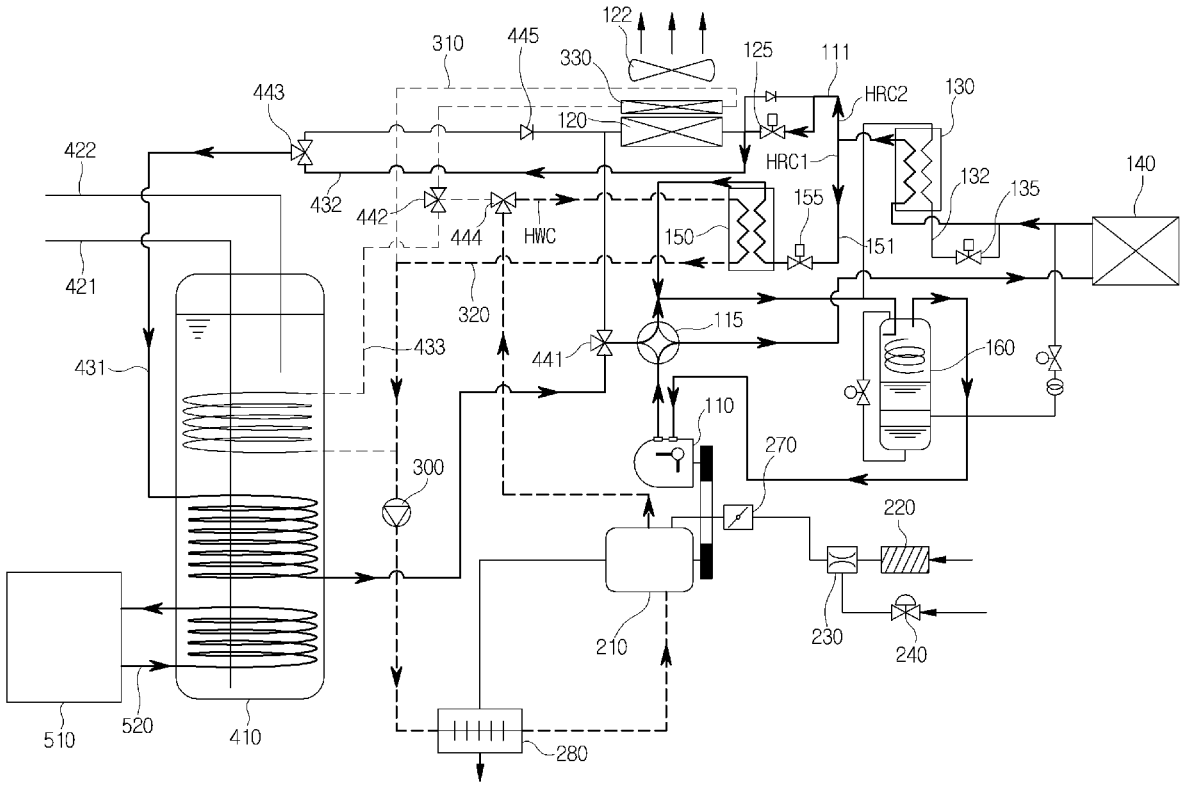
FIG. 8 is a view schematically illustrating the gas heat-pump system in the heating operation mode according to the second embodiment of the present disclosure.
Figure 9:
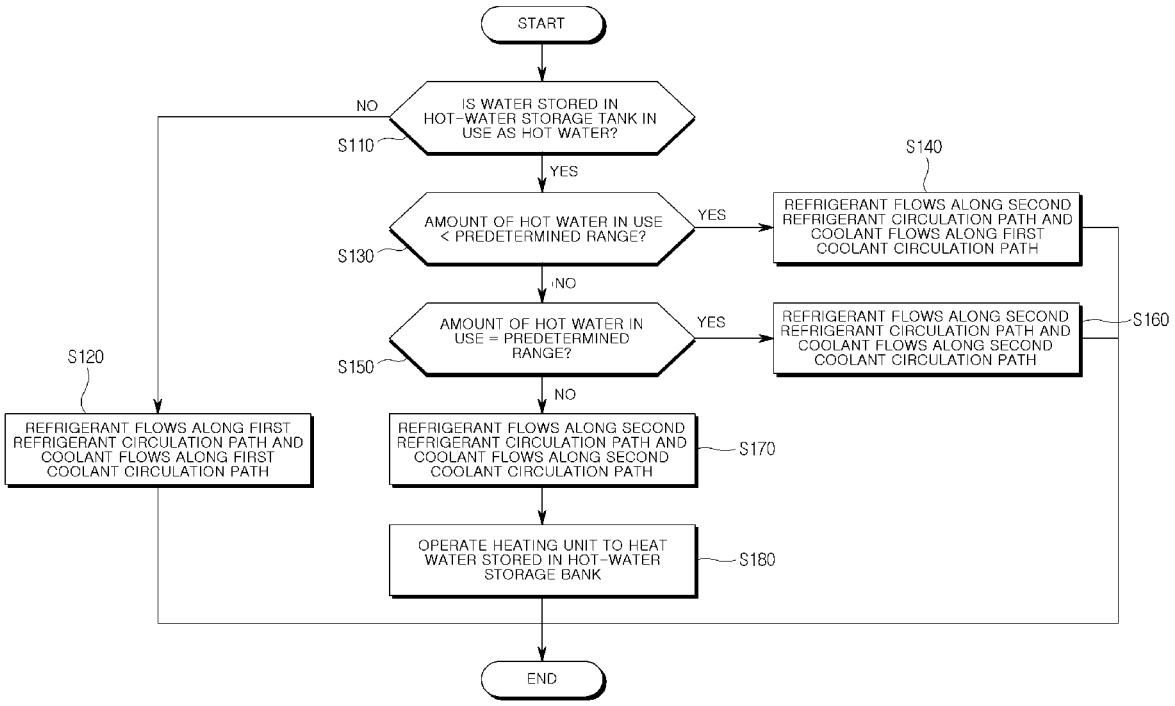
FIG. 9 is a flowchart schematically illustrating a method of controlling the gas heat-pump system in the cooling operation mode according to the present disclosure.
Figure 10:
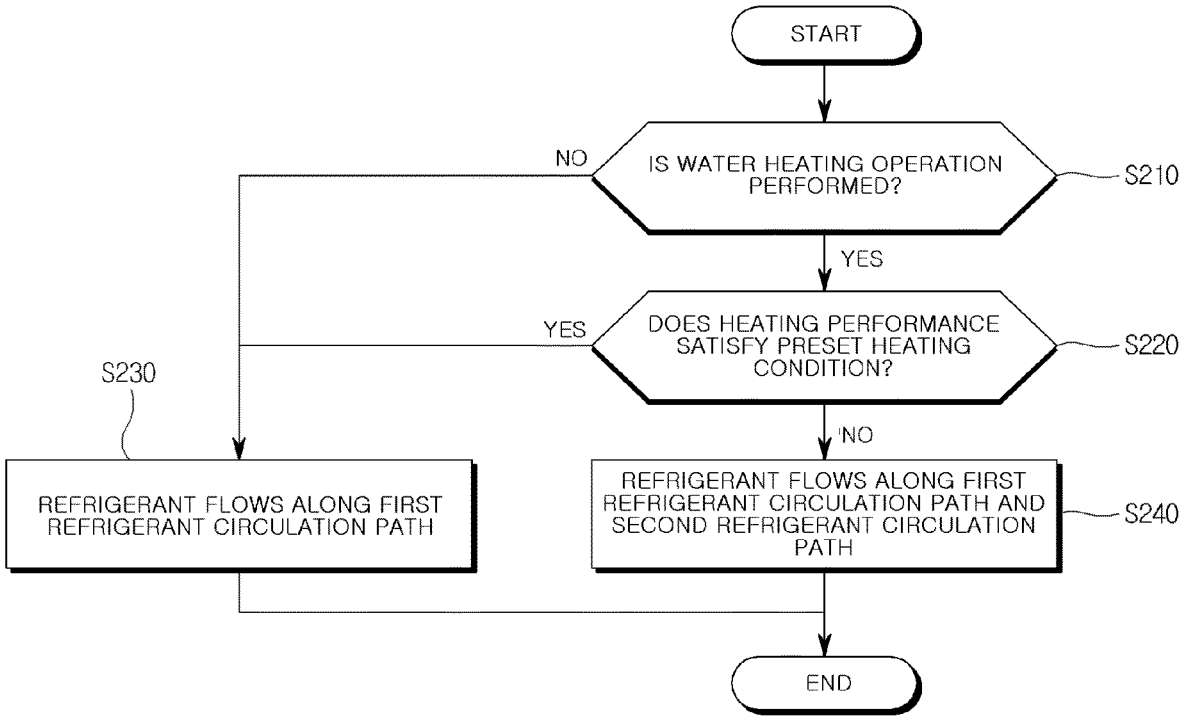
FIG. 10 is a flowchart schematically illustrating a method of controlling the gas heat-pump system in the heating operation mode according to the present disclosure.

FIGS. 2 to 6 are views illustrating gas heat-pump systems operating in a cooling operation mode according to first to fifth embodiments, respectively, of the present disclosure. FIGS. 7 and 8 are views illustrating the gas heat-pump systems in a heating operation mode according to the first and second embodiments, respectively, of the present disclosure.

With reference to FIG. 1, the gas heat-pump system 11 according to the present disclosure includes an air conditioning module, an engine module, and a cooling module. The gas heat-pump system may further include a hot-water storage tank module that recovers waste heat from refrigerant and coolant and uses the waste heat as a heat source.

The air conditioning module includes a plurality of components that are configured for cooling or heating an indoor space using a refrigeration cycle.

As an example, the air conditioning module includes a compressor 110, a four-way valve 115, an outdoor heat exchanger 120, an indoor heat exchanger 140, and a gas-liquid separator 160. The compressor 110 compresses the refrigerant. The four-way valve 115 switches a flow direction of the refrigerant compressed in the compressor 110 in a manner that corresponds to the cooling operation mode and the heating operation mode. The outdoor heat exchanger 120 condenses the refrigerant. The indoor heat exchanger 140 causes heat exchange to occur between indoor air and the refrigerant and thus cools or heats the indoor space. The gas-liquid separator 160 separates liquid refrigerant and gaseous refrigerant from each other. The outdoor heat exchanger 120 here is installed in an outdoor air conditioning condenser unit. An outdoor fan 122 is provided in the outdoor air conditioning condenser unit. The driving of the outdoor fan 122 causes the heat exchange to occur between outdoor air and the refrigerant passing through the outdoor heat exchanger 120, thereby cooling the refrigerant.

In the cooling operation mode, the air conditioning module with this configuration operates as follows. The refrigerant discharged in a compressed state from the compressor 110 is supplied by operation of the four-way valve 115 to the outdoor heat exchanger 120. The refrigerant condensed in the outdoor heat exchanger 120 is supplied to the indoor heat exchanger 140, exchanges heat with the indoor air, and thus evaporates, thereby cooling the indoor air. Thereafter, the evaporating refrigerant passes through the four-way valve 115 and then is separated into the liquid refrigerant and the gaseous refrigerant by the gas-liquid separator 160. The resulting gaseous refrigerant is supplied to the compressor 110 and circulates.

A main expansion valve 125 for depressurizing the refrigerant is provided to the exist side of the outdoor heat exchanger 120. A depressurizing operation by the main expansion valve 125 further cools the refrigerant passing through the outdoor heat exchanger 120.

A supercooling heat exchanger 130, a supercooling flow path 132, and a supercooling expansion valve 135 may be further provided to the exit side of the main expansion valve 125. The supercooling heat exchanger 130 additionally cools the refrigerant. The supercooling flow path 132 branches off from the main refrigerant line 111 connecting the outdoor heat exchanger 120 and the indoor heat exchanger 140 to each other, passes through the supercooling heat exchanger 130 and is connected to the gas-liquid separator 160. The supercooling expansion valve 135 is provided on the supercooling flow path 132 in such a manner as to be positioned to the entrance side of the supercooling heat exchanger 130 and depressurizes the refrigerant.

With this configuration, a depressurizing operation by the supercooling expansion valve 135 cools the refrigerant flowing out of the supercooling flow path 132. The cooled refrigerant is further cooled while passing through the main refrigerant line 111 in the supercooling heat exchanger 130 and then is discharged to the gas-liquid separator 160.

Furthermore, in the heating operation mode, the air conditioning module operates as follows. The refrigerant discharged in the compressed state from the compressor 110 is supplied by the operation of the four-way valve 115 to the indoor heat exchanger 140, exchanges heat with the indoor air, and is condensed, thereby heating the indoor air. Thereafter, the refrigerant exchanges heat with the coolant heated in an auxiliary heat exchanger 150 and evaporates. Thereafter, the refrigerant passes through the four-way valve 115 and then is separated into the liquid refrigerant and the gaseous refrigerant by the gas-liquid separator 160. The resulting gaseous refrigerant is supplied to the compressor 110 and circulates.

To this end, the air conditioning module may further include an auxiliary refrigerant line 151 and an auxiliary expansion valve 155. The auxiliary refrigerant line 151 branches off from the main refrigerant line 111 connecting the indoor heat exchanger 140 and the outdoor heat exchanger 120 to each other, passes through the auxiliary heat exchanger 150, and then is connected to the compressor 110. The auxiliary expansion valve 155 opens and closes the auxiliary refrigerant line 151 between the indoor heat exchanger 140 and the auxiliary heat exchanger 150. The auxiliary expansion valve 155 here may operate in such a manner as to depressurize the refrigerant introduced into the auxiliary heat exchanger 150.

The engine module includes a plurality of components that are configured to provide a drive force for compressing the refrigerant in the compressor 110.

As an example, the engine module includes an engine 210, a mixer 230, an air filter 220, a zero governor 240, and a flow control unit 270. The engine 210 combusts mixed gas and thus generates a motive force. The mixer 230 is arranged to the entrance side of the engine 210 and supplies the mixed gas. The air filter 220 supplies purified air to the mixer 230. The zero governor 240 supplies fuel at a predetermined pressure or lower. The flow control unit 270 is arranged between the engine 210 and the mixer 230 and controls an amount of the mixed gas to be supplied to the engine 210. The flow control unit 270 here is provided as a valve that employs an electronic throttle control (ETC) scheme.

With this configuration, the amount of the mixed gas that results from the mixer 230 mixing air supplied in a purified state by the air filter 220 and fuel supplied at predetermined pressure by the zero governor 240 is controlled by the flow control unit 270, and then the resulting mixed gas is supplied to the engine 210, thereby generating the motive force in the engine 210. The motive force that is generated in this manner in the engine 210 is provided as the drive force for operating the compressor 110. Of course, although not illustrated, a turbocharger (not illustrated) may be further provided for supplying compressed mixed gas to the engine 210.

The cooling module includes a plurality of components that are configured to supply the coolant for cooling the engine 210.

As an example, the coolant module includes a radiator 330 and a main coolant line 310. The radiator 330 cools the coolant heated while passing through the engine 210. The main coolant line 310 connects the engine 210 and the radiator 330 to each other. The radiator 330 is installed in the outdoor air conditioning condenser unit, and the outdoor fan 122 is installed in the outdoor air conditioning condenser unit. With this arrangement, the driving of the outdoor fan 122 causes the heat exchange to occur between the outdoor air and the coolant passing through the radiator 330, thereby cooling the coolant.

The coolant module may further include a coolant pump 300 that is arranged on the main coolant line 310 and forces the coolant to flow into the engine 210.

The coolant module may further include an exhaust gas heat exchanger 280 that is arranged on the main coolant line 310 in such a manner as to be positioned to the exhaust outlet side of the engine 210 and causes the heat exchange to occur between the coolant flowing along the main coolant line 310 and exhaust gas discharged from the engine 210.

Furthermore, the coolant module may further include an auxiliary coolant line 320 and a fourth three-way valve 444. The auxiliary coolant line 320 branches off from the main coolant line 310 connecting the engine 210 and a second three-way valve 442 to each other, passes through the auxiliary heat exchanger 150, and then is connected to the main coolant line 310 positioned to the exit side of the radiator 330. The fourth three-way valve 444 is provided at a point where the auxiliary coolant line 320 branches off from the main coolant line 310.

The fourth three-way valve 444 switches a flow direction of the coolant in such a manner that the coolant passing through the engine 210 flows along the main coolant line 310 or the auxiliary coolant line 320. That is, the fourth three-way valve 444 switches the flow direction of the coolant in such a manner that the coolant passing through the engine 210 flows toward the radiator 330 or the auxiliary heat exchanger 150.

The hot-water storage tank module includes a plurality of components that are configured to recover waste heat from the refrigerant and the coolant or uses the waste heat as a heat source.

As an example, the hot-water storage tank module includes a hot-water storage tank 410, a hot-water storage tank refrigerant line 431, and the first three-way valve 441. Water is stored in the hot-water storage tank 410. The hot-water storage tank refrigerant line 431 branches off from the main refrigerant line 111 and passes through the hot-water storage tank 410. The first three-way valve 441 is provided at a point where the hot-water storage tank refrigerant line 431 branches off from the main refrigerant line 111.

The water storage tank 410 here is configured to store water that is in use as hot water. That is, in a case where a user uses the hot water, a heating unit 510 performs a water heating operation of heating the stored water. Thus, the water stored in the hot-water storage tank 410 is heated and the heated water is supplied as the hot water. At this time, an amount of hot water that can be used by the user varies according to an amount of heat supplied to the hot-water storage tank 410.

A hot-water storage tank supply line 421 and a hot-water storage tank discharge line 422 are provided on the hot-water storage tank 410. The water is supplied through the hot-water storage tank supply line 421. The hot water produced by heating the water in the hot-water storage tank 410 is discharged to the outside through the hot-water storage tank discharge line 422.

The hot-water storage tank discharge line 422 is configured to discharge the hot water produced by heating the water to the outside. The water heated in the hot-water storage tank 410 moves upward. Thus, an end portion of the hot-water storage tank discharge line 422 is desirably arranged on an upper portion of the hot-water storage tank 410.

The hot-water storage tank supply line 421 is configured to supply low-temperature water to the hot-water storage tank 410. In order to minimize an effect on the heated water moving upward, an end portion of the hot-water storage tank supply line 421 is desirably arranged on the bottom surface side of the hot-water storage tank 410 in such a manner that the low-temperature water is supplied from a bottom of the hot-water storage tank 410.

The hot-water storage tank module includes the hot-water storage tank refrigerant line 431, the first three-way valve 441, a hot-water storage tank coolant line 433, and a second three-way valve 442. The hot-water storage tank refrigerant line 431 branches off from the main refrigerant line 111 connecting the four-way valve 115 and the outdoor heat exchanger 120 to each other, passes through the hot-water storage tank 410 for the heat exchange, and then is connected to the outdoor heat exchanger 120. The first three-way valve 441 switches the flow direction of the refrigerant in such a manner that the refrigerant passing through the four-way valve 115 flows along the main refrigerant line 111 or the hot-water storage tank refrigerant line 431. The hot-water storage tank coolant line 433 branches off from the main coolant line 310 connecting the engine 210 and the radiator 330 to each other, passes through the hot-water storage tank 410 for the heat exchange, and then is connected to the engine 210. The second three-way valve 442 switches the flow direction of the coolant in such a manner that the coolant passing through the engine 210 flows along the main coolant line 310 or the hot-water storage tank coolant line 433.

With this configuration, in the cooling operation mode, the refrigerant discharged from the compressor 110 is supplied to the hot-water storage tank refrigerant line 431 for primary condensing in the hot-water storage tank 410, and then the resulting refrigerant is supplied to the outdoor heat exchanger 120 for secondary condensing. At this time, the water stored in the hot-water storage tank 410 is heated with the refrigerant, and thus the waste heat is recovered from the refrigerant.

In the cooling operation mode, the coolant with which the engine 210 is cooled is supplied to the hot-water storage tank coolant line 433 and is cooled in the hot-water storage tank 410, and then the cooled coolant is supplied back to the engine 210. At this time, the water stored in the hot-water storage tank 410 is heated with the coolant, and thus the waste heat is recovered from the coolant.

The hot-water storage tank module may further include a branch refrigerant line 432, a third three-way valve 443, and an on-off valve 445.

The branch refrigerant line 432 branches off from the main refrigerant line 111 connecting the indoor heat exchanger 140 and the outdoor heat exchanger 120 to each other and is connected to the hot-water storage tank refrigerant line 431 connecting the hot-water storage tank 410 and the outdoor heat exchanger 120 to each other.

The third three-way valve 443 is provided on a junction between the branch refrigerant line 432 and the hot-water storage tank refrigerant line 431 to selectively connect the hot-water storage tank refrigerant line 431 and the branch refrigerant line 432 to each other. In the cooling operation mode, the third three-way valve 443 may switch the flow direction of the refrigerant in such a manner that the refrigerant passes through the outdoor heat exchanger 120 and then flows along the main refrigerant line 111 or flows along the main refrigerant line 111 through the branch refrigerant line 432.

The on-off valve 445 is provided on the hot-water storage tank refrigerant line 431 between the third three-way valve 443 and the outdoor heat exchanger 120. The on-off valve 445 operates to open the hot-water storage tank refrigerant line 431 in the cooling operation mode and to close the hot-water storage tank refrigerant line 431 in the heating operation mode.

The hot-water storage tank module includes a heating line 520 and a heating unit 510. The heating line 520 passes through the inside of the hot-water storage tank 410 for the heat exchange with the water stored in the hot-water storage tank 410. The heating unit 510 heats the water passing through the heating line 520. That is, the water stored in the hot-water storage tank 410 is heated with the heating line 520 and the heating unit 510.

Furthermore, the hot-water storage tank coolant line 433 of the hot-water storage tank module is arranged inside of an upper portion of the hot-water storage tank 410, the heating line 520 of the hot-water storage tank module is arranged inside of a lower portion thereof, and the hot-water storage tank refrigerant line 431 of the hot-water storage tank module is arranged inside of the middle portion thereof at a position midway between the hot-water storage tank coolant line 433 and the heating line 520. Of course, the present disclosure is not limited to this arrangement. The hot-water storage tank refrigerant line 431 may be arranged inside of the upper portion of the hot-water storage tank 410, and the hot-water storage tank coolant line 433 may be arranged inside of the middle portion thereof. That is, positions in which the lines are arranged may be changed according to an operating condition that is set up by a user.

A method of controlling the gas heat-pump system according to the present disclosure will be described below with reference to the accompanying drawings.

The gas heat-pump system includes first to third refrigerant circulation paths CRC1, CRC2, and CRC3, and first and second coolant circulation paths CWC1 and CWC2. In the cooling operation mode, according to the operating condition, the refrigerant circulates along the first to third refrigerant circulation paths CRC1, CRC2, and CRC3, and the coolant circulates along the first and second coolant circulation path CWC1 and CWC2.

Figure 2:
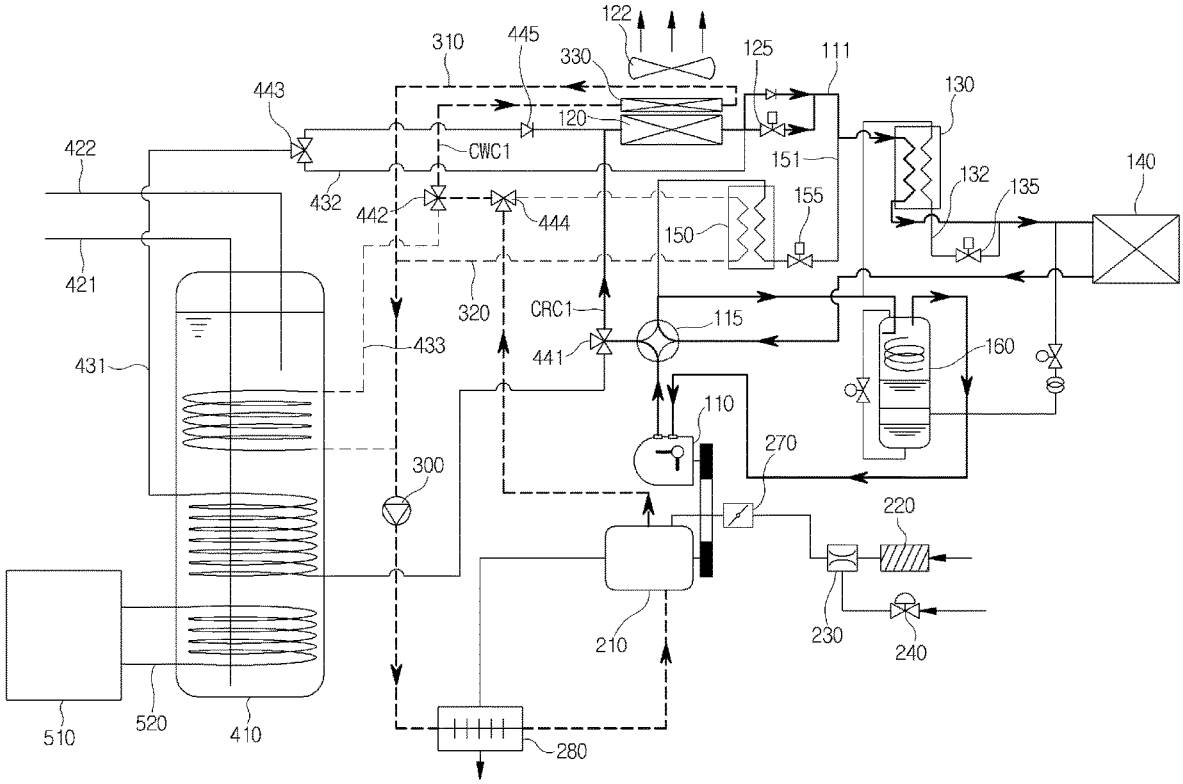
FIG. 2 is a view schematically illustrating a gas heat-pump system operating in a cooling operation mode according to a first embodiment of the present disclosure.

More specifically, with reference to FIG. 2, the first refrigerant circulation path CRC1 is a path along which the refrigerant discharged from the compressor 110 circulates to the compressor 110 after being cooled in the outdoor heat exchanger 120 and then exchanging heat with the indoor air the indoor heat exchanger 140.

As an example, the first refrigerant circulation path CRC1 is configured in such a manner that the refrigerant discharged from the compressor 110 flows by the operation of the four-way valve 115 toward the first three-way valve 441 and flows by the operation of the first three-way valve 441 to the main refrigerant line 111 for being supplied to the outdoor heat exchanger 120. Furthermore, the first refrigerant circulation path CRC1 is configured in such a manner that the refrigerant condensed while passing through the outdoor heat exchanger 120 is cooled while passing through the main expansion valve 125, exchanges heat in the indoor heat exchanger 140, thereby cooling the indoor air, and then passes through the first three-way valve 441 for being supplied to the gas-liquid separator 160, and that only the gaseous refrigerant resulting from the gas-liquid separation is supplied back to the compressor 110.

Figure 3:
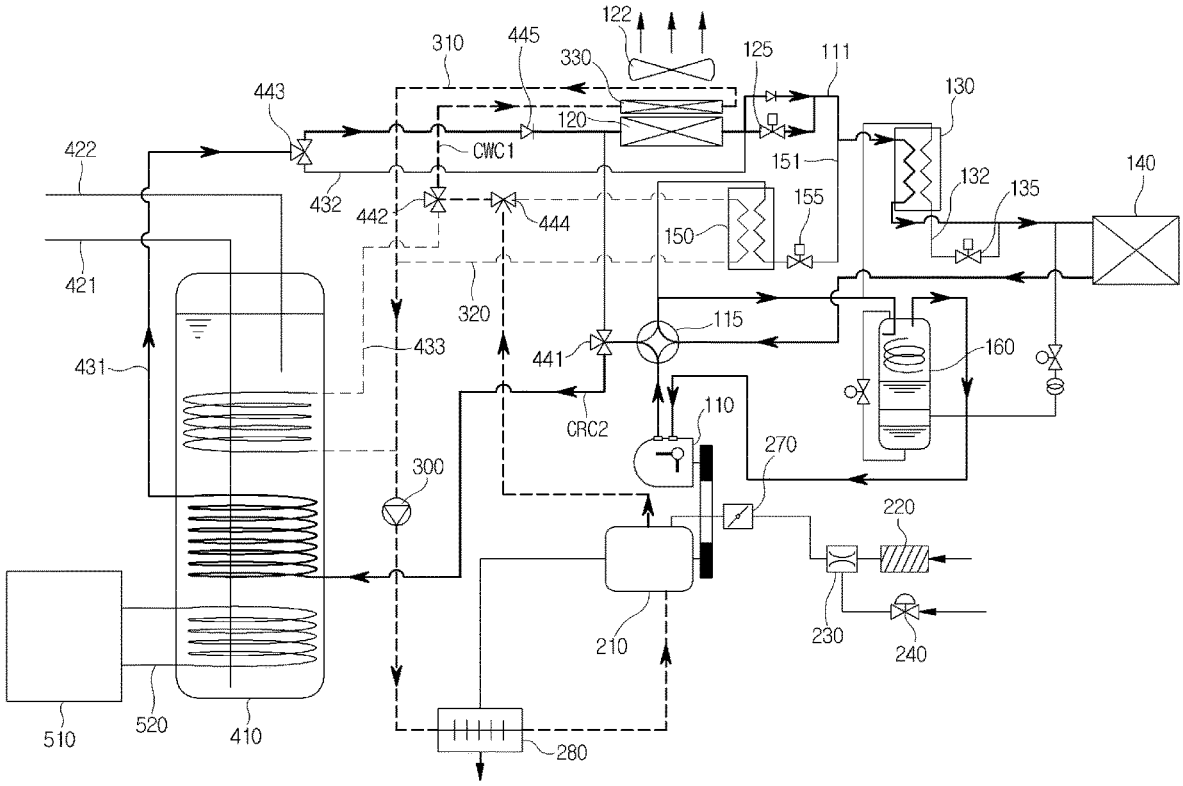
FIG. 3 is a view schematically illustrating a gas heat-pump system operating in the cooling operation mode according to a second embodiment of the present disclosure.

With reference to FIG. 3, the second refrigerant circulation path CRC2 is a path along which the refrigerant discharged from the compressor 110 is cooled in the hot-water storage tank 410 and then in the outdoor heat exchanger 120, passes through the indoor heat exchanger 140, and then circulates to the compressor 110.

As an example, the second refrigerant circulation path CRC2 is configured in such a manner that the refrigerant discharge from the compressor 110 flows by the operation of the four-way valve 115 toward the first three-way valve 441 and flows by operation of the first three-way valve 441 to the hot-water storage tank refrigerant line 431 for being supplied to the hot-water storage tank 410. Furthermore, the second refrigerant circulation path CRC2 is configured in such a manner that the refrigerant primarily condensed while passing through the hot-water storage tank 410 flows by operation of the third three-way valve 443 to the outdoor heat exchanger 120, thereby being additionally condensed, is cooled while passing through the main expansion valve 125, exchanges heat in the indoor heat exchanger 140, thereby cooling the indoor air, and then passes through the first three-way valve 441 for being supplied to the gas-liquid separator 160, and that only the gaseous refrigerant resulting from the gas-liquid separation is supplied back to the compressor 110.

Figure 6:
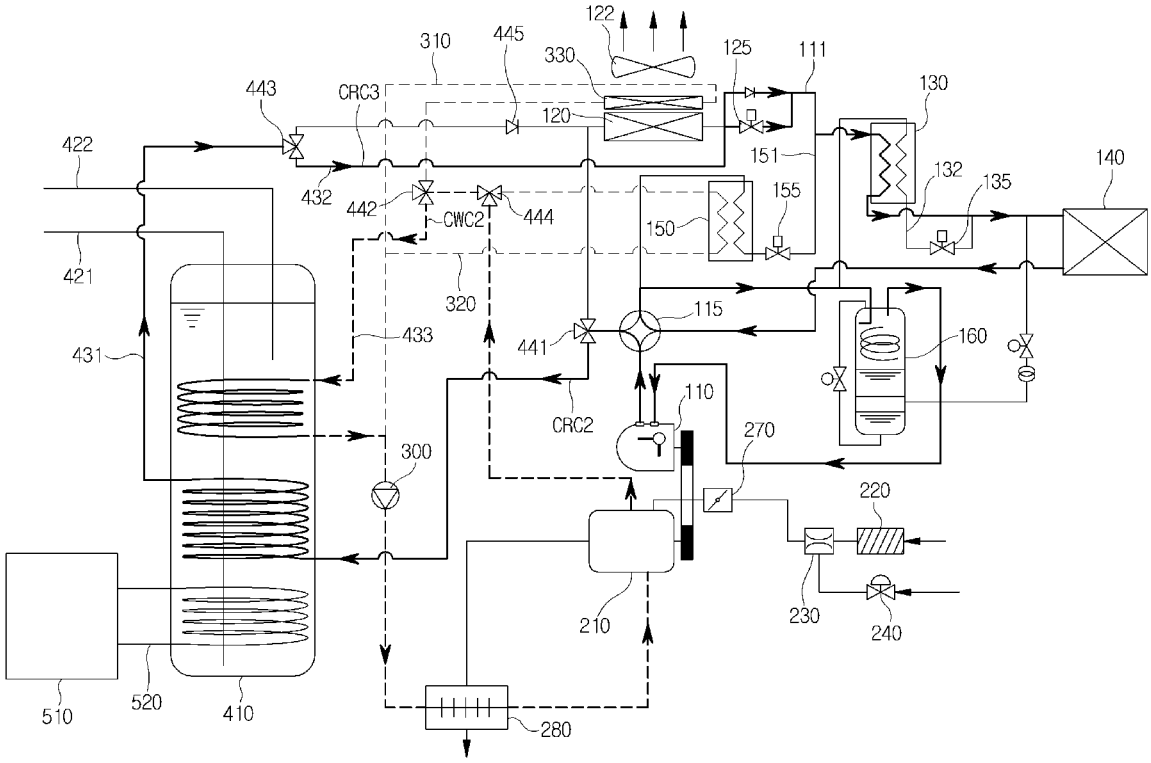
FIG. 6 is a view schematically illustrating a gas heat-pump system in the cooling operation mode according to a fifth embodiment of the present disclosure.

With reference to FIG. 6, the third refrigerant circulation path CRC3 is a path along which the refrigerant discharged from the compressor 110 is cooled in the hot-water storage tank 410, bypasses the indoor heat exchanger 140, and then circulates to the compressor 110.

As an example, the third refrigerant circulation path CRC3 is configured in such a manner that the refrigerant discharged from the compressor 110 flows by the operation of the four-way valve 115 toward the first three-way valve 441 and flows by the operation of the first three-way valve 441 to the hot-water storage tank refrigerant line 431 for being supplied to the hot-water storage tank 410. Furthermore, the third refrigerant circulation path CRC3 is configured in such a manner that the refrigerant primarily condensed while passing through the hot-water storage tank 410 flows by the operation of the third three-way valve 443 to the branch refrigerant line 432, bypasses the outdoor heat exchanger 120, is cooled while passing through the main expansion valve 125, exchanges heat in the indoor heat exchanger 140, thereby cooling the indoor air, and then passes through the first three-way valve 441 for being supplied to the gas-liquid separator 160, and that only the gaseous refrigerant resulting from the gas-liquid separation is supplied back to the compressor 110.

With reference to FIG. 2, the first coolant circulation path CWC1 is a path along which the coolant cooling the engine 210 is cooled in the radiator 330 and then circulates to the engine 210.

As an example, the first coolant circulation path CWC1 is configured in such a manner that the coolant cooling the engine 210 flows by the operation of the fourth three-way valve 444 and by operation of the second three-way valve 442 to the main coolant line 310 for being supplied to the radiator 330, is cooled by the outdoor fan 122 in the radiator 330, cools the exhaust gas in the exhaust gas heat exchanger 280 while being forced to flow by the coolant pump 300, and then is supplied back to the engine 210.

Figure 4:
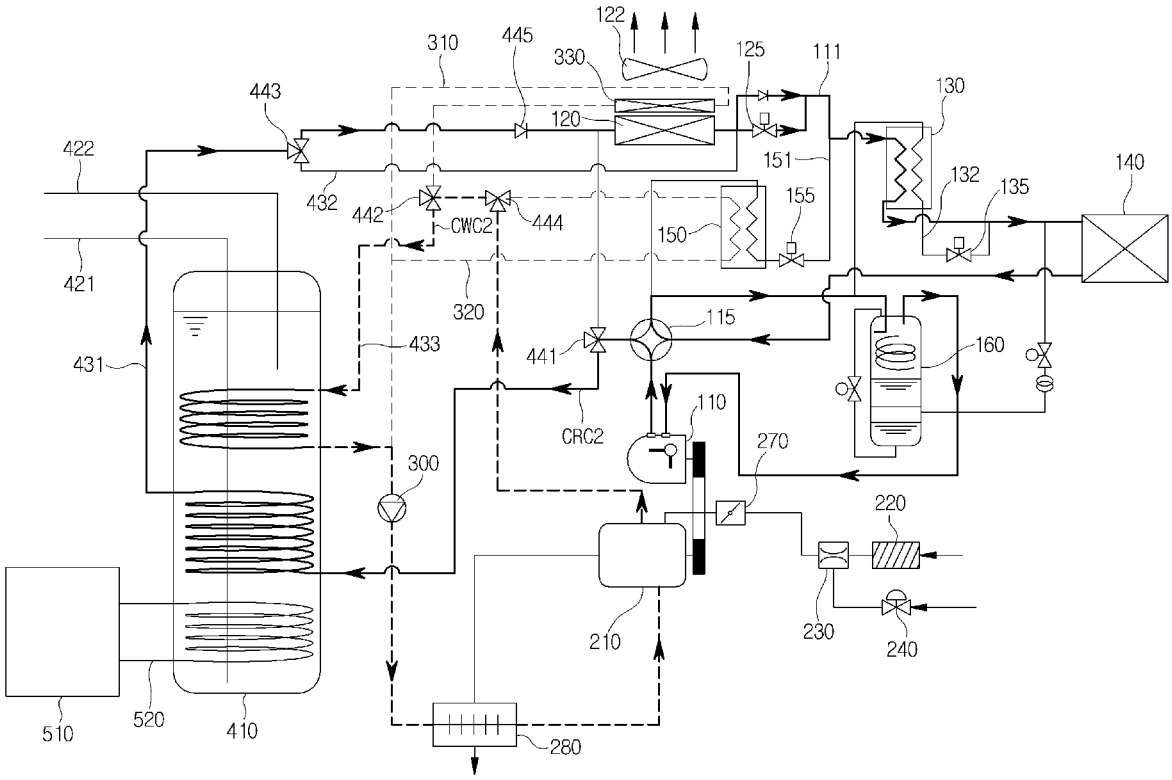
FIG. 4 is a view schematically illustrating a gas heat-pump system operating in the cooling operation mode according to a third embodiment of the present disclosure.

With reference to FIG. 4, the second coolant circulation path CWC2 is a path along which the coolant cooling the engine 210 is cooled in the hot-water storage tank 410 and then circulates to the engine 210.

As an example, the second coolant circulation path CWC2 is configured in such a manner that the coolant cooling the engine 210 flows by operation of the fourth three-way valve 444 to the main coolant line 310, flows by the operation of the second three-way valve 442 to the hot-water storage tank coolant line 433 for being supplied to the hot-water storage tank 410, passes through the hot-water storage tank 410, cools the exhaust gas in the exhaust gas heat exchanger 280 while being forced by the coolant pump 300 to flow, and then is supplied back to the engine 210.

A method of controlling the gas heat-pump system in the cooling operation mode according to the present disclosure will be described below with reference to the above-described refrigerant circulation path and coolant circulation path.

The method of controlling the gas heat-pump system in the cooling operation mode includes a hot-water-in-use determination step S110, a hot-water-in-use amount determination step, and a circulation path control step. In the hot-water-in-use determination step S110, it is determined whether or not the water stored in the hot-water storage tank 410 is in use as the hot water. In the hot-water-in-use amount determination step, when the water stored in the hot-water storage tank 410 is in use as the hot water, temperature of the water stored in the hot-water storage tank 410 is measured, and thus an amount of the hot water in use is determined. In the circulation path control step, paths along which the refrigerant and the coolant circulate are determined in manner that corresponds to whether or not the water stored in the hot-water storage tank 410 is in use as the hot water or and the amount of the hot water in use.

In the circulation path control step, when it is determined that the water stored in the hot-water storage tank 410 is not in use as the hot water (NO in S110), as illustrated in FIG. 2, control is performed in such a manner that the refrigerant flows along the first refrigerant circulation path CRC1 and that the coolant flows along the first coolant circulation path CWC1.

That is, when the hot water is not in use, there is a need to heat the water stored in the hot-water storage tank 410. Therefore, control is performed in such a manner that the refrigerant and the coolant circulate within the air conditioning module without flowing toward the hot-water storage tank 410 and that the indoor space is thus cooled.

In the circulation path control step, when the amount of the hot water in use falls short of being within a predetermined range (YES in S130), as illustrated in FIG. 3, controls is performed in such a manner that the refrigerant flows along the second refrigerant circulation path CRC2 and that the coolant flows along the first coolant circulation path CWC1.

That is, in a case where the amount of the hot water in use is small, the waste heat is recovered from the refrigerant in the hot-water storage tank 410, the water stored in the hot-water storage tank 410 is heated with the recovered waste heat, and the heated water is in use as the hot water. When the water stored in the hot-water storage tank 410 is heated with the waste heat recovered from the refrigerant, the heating unit 510 is not used. Thus, energy can be saved.

In the circulation path control step, when the amount of the hot water in use falls within the predetermined range (YES in S150), as illustrated in FIG. 4, the control is performed in such a manner that the refrigerant flows along the second refrigerant circulation path CRC2 and the coolant flows along the second coolant circulation path CWC2.

That is, when the amount of the hot water in use occurs to some degree, in a state where the waste heat is recovered from the refrigerant in the hot-water storage tank 410 through the second refrigerant circulation path CRC2, control is performed in such a manner that the coolant flows along the second coolant circulation path CWC2. Thus, with this control, the waste heat is also recovered from the coolant in the hot-water storage tank 410, thereby heating a larger amount of the water. That is, the water stored in the hot-water storage tank 410 is heated with the waste heat recovered from the refrigerant and the coolant without using the heating unit 510. Thus, the energy can be saved.

Figure 5:
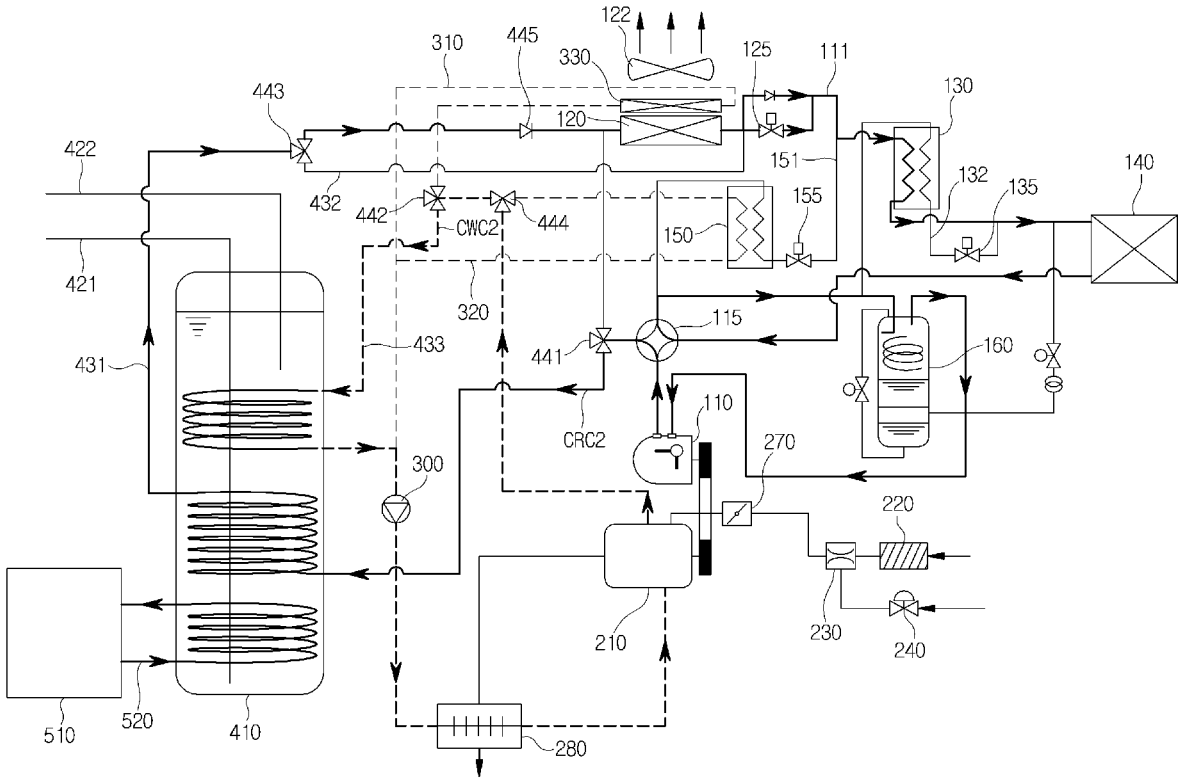
FIG. 5 is a view schematically illustrating a gas heat-pump system in the cooling operation mode according to a fourth embodiment of the present disclosure.

In the circulation path control step, when the amount of the hot water in use exceeds the predetermined range (NO in S150), as illustrated in FIG. 5, the control is performed in such a manner that the refrigerant flows along the second refrigerant circulation path CRC2 and that the coolant flows along the second coolant circulation path CWC2. Furthermore, control is performed in such a manner that the heating unit 510 connected to the hot-water storage tank 410 with the heating line 520 operates to heat the water stored in the hot-water storage tank 410.

That is, when the amount of the hot water in use is increased, only with the waste heat recovered through the second refrigerant circulation path CRC2 and the second coolant circulation path CWC2, it is difficult to continuously heat and supply the water to be in continuous use. Therefore, the heating unit 510 additionally supplies heat, thereby heating the water stored in the hot-water storage tank 410.

In this manner, when the hot water begins to be in use, control is performed in such a manner that the refrigerant flows along the second refrigerant circulation path CRC2. Furthermore, when the hot water is in continuous use, control is performed in such a manner that the coolant flows along the second coolant circulation path CWC2. Furthermore, when the hot water is further in continuous use, control is additionally performed in such a manner that the heating unit 510 operates.

Therefore, in a case where the hot water is in use, when the amount of the hot water in use falls within the predetermined range, the water stored in the hot-water storage tank 410 is heated with the waste heat recovered from the refrigerant and the coolant. Thus, the energy can be saved.

In addition, in the circulation path control step, when the amount of the hot water in use falls within the predetermined range, as illustrated in FIG. 6, control may be performed in such a manner that the refrigerant flows along the third refrigerant circulation path CRC3 and that the coolant flows along the second coolant circulation path CWC2. In this manner, when the refrigerant and the coolant are allowed to flow, the coolant and the refrigerant do not flow to the radiator 330 and the outdoor heat exchanger 120. Thus, the outdoor fan 122 does not need to be driven. Thus, the energy can be additionally saved.

The gas heat-pump system includes first and second refrigerant circulation paths HRC1 and HRC2 and a coolant circulation path HWC. In the heating operation mode, according to the operating condition, the refrigerant circulates along the first and second refrigerant circulation paths HRC1 and HRC2, and the coolant circulates along the coolant circulation path HWC.

More specifically, with reference to FIG. 7, the first refrigerant circulation path HRC1 is a path along which the refrigerant discharged from the compressor 110 exchanges heat in the indoor heat exchanger 140, is heated in the auxiliary heat exchanger 150, and then circulates to the compressor 110.

As an example, the first refrigerant circulation path HRC1 is configured in such a manner that the refrigerant discharged from the compressor 110 flows by the operation of the four-way valve 115 to the main refrigerant line 111 for being supplied to the indoor heat exchanger 140, and exchanges heat with the indoor air in the indoor heat exchanger 140, thereby being condensed. Furthermore, the first refrigerant circulation path HRC1 is configured in such a manner that the resulting condensed refrigerant passes through the auxiliary expansion valve 155, flows along the auxiliary refrigerant line 151 for being supplied to the auxiliary heat exchanger 150, and absorbs heat in the auxiliary heat exchanger 150, thereby evaporating. The first refrigerant circulation path HRC1 is configured in such a manner that the resulting evaporating refrigerant is supplied to the gas-liquid separator 160, and that only the gaseous refrigerant resulting from the gas-liquid separation is supplied back to the compressor 110.

With reference to FIG. 8, the second refrigerant circulation path HRC2 is a path along which the refrigerant discharged from the compressor 110 exchanges heat in the indoor heat exchanger 140, is heated in the hot-water storage tank 410, and then circulates to the compressor 110.

As an example, the second refrigerant circulation path HRC2 is configured in such a manner that the refrigerant discharged from the compressor 110 flows by the operation of the four-way valve 115 to the main refrigerant line 111 and flows to the indoor heat exchanger 140. Furthermore, the second refrigerant circulation path HRC2 is configured in such a manner that the refrigerant condensed after exchanging heat with the indoor air in the indoor heat exchanger 140 passes through the main expansion valve 125, flows along the branch refrigerant line 432, and flows by the operation of the third three-way valve 443 to the hot-water storage tank refrigerant line 431 for being supplied to the hot-water storage tank 410. Furthermore, the second refrigerant circulation path HRC2 is configured in such a manner that the refrigerant evaporating as a result of absorbing heat in the hot-water storage tank 410 is supplied by the operation of the first three-way valve 441 and by the operation of the four-way valve 115 to the gas-liquid separator 160, and that only the gaseous refrigerant resulting from the gas-liquid separation is supplied back to the compressor 110.

With reference to FIG. 8, the coolant circulation path HWC is a path along which the coolant cooling the engine 210 is cooled in the auxiliary heat exchanger 150 and then circulates to the engine 210.

As an example, the coolant circulation path HWC is configured in such a manner that the coolant cooling the engine 210 flows by the fourth three-way valve 444 to the auxiliary coolant line 320 for being supplied to the auxiliary heat exchanger 150, exchanges heat with the refrigerant in the auxiliary heat exchanger 150, resulting in being cooled, cools the exhaust gas in the exhaust gas heat exchanger 280 while being forced by the coolant pump 300 to flow, and then is supplied back to the engine 210.

A method of controlling the gas heat-pump system in the heating operation mode according to the present disclosure will be described below with reference to the above-described refrigerant circulation path and coolant circulation path.

The method of controlling the gas heat-pump system in the heating operation mode includes a water heating operation determination step S210, a heating performance determination step S220, and a refrigerant circulation path control step. In the water heating operation determination step S210, it is determined whether or not a water heating operation of operating the heating unit 510 to heat the water stored in the hot-water storage tank 410 for use as the hot water is performed. In the heating performance determination step S220, heating performance is determined, depending on whether or not the water heating operation is performed in a manner that satisfies a preset heating condition. In the refrigerant circulation path control step, a path along which the refrigerant circulates is determined in a manner that corresponds to whether or not the water heating operation is performed and the heating performance.

In the heating performance determination step, it is determined whether or not temperature of air discharged from the indoor heat exchanger 140 is target temperature that satisfies the preset heating condition.

As an example, in a case where the user sets the heating condition to 25° C., in order to raise indoor temperature to 25° C. within a preset time, the target temperature of the air supplied to the indoor space is set to 30° C. In this case, when the temperature of the air discharged that is heated as a result of the heat exchange in the indoor heat exchanger 140 is measured, if the temperature of the air does not reach the target temperature of 30° C., it is determined that the heating performance does not satisfy the preset heating condition. Of course, the above-described heating performance is only an example. The heating performance may be determined by various external factors, such as a size of the indoor space and the operating condition.

In the refrigerant circulation path control step, when it is determined that the water heating operation is not determined (NO in Step S210), as illustrated in FIG. 7, control is performed in such a manner that the refrigerant flows along the first refrigerant circulation path HRC1. At this point, the coolant circulates along the coolant circulation path HWC.

That is, when the hot water is not in use, the water stored in the hot-water storage tank 410 is not heated and remains at low temperature. Therefore, control is performed in such a manner that the refrigerant flows along the first refrigerant circulation path HRC1 and evaporates in the auxiliary heat exchanger 150.

In the refrigerant circulation path control step, when the water heating operation is performed (YES in S210) and the heating performance does not satisfy the preset heating condition (NO in S220), as illustrated in FIG. 8, control is performed in such a manner that the refrigerant flows along both the first refrigerant circulation path HRC1 and the second refrigerant circulation path HRC2. At this point, the coolant circulates along the coolant circulation path HWC.

That is, when the hot water is in use, the water heating operation is performed. Thus, the water stored in the hot-water storage tank 410 is heated and is stored in a high-temperature state. The reason that the heating performance does not satisfy the preset heating condition is that the heating performance cannot be achieved only with an amount of heat supplied from the auxiliary heat exchanger 150. Therefore, it is determined that there is a need to supply an additional amount of heat to the refrigerant.

Accordingly, in order to supply the additional amount of heat, control is performed in such a manner that a portion of the refrigerant circulates along the second refrigerant circulation path HRC2 and absorbs heat from the hot water, heated to high temperature, in the hot-water storage tank 410. Thus, the heating condition can be satisfied.

Therefore, in a case where the heating condition is not satisfied, the heat is additionally supplied from the hot-water storage tank 410. Thus, the heating condition can be satisfied, and the heating performance can be accordingly improved.

Although the specific embodiment of the present disclosure has been described for illustrative purposes, those skilled in the art will appreciate that various modifications, additions and substitutions are possible, without departing from the scope and spirit of the disclosure as disclosed in the accompanying claims.

What is claimed is:

1. A gas heat-pump system, comprising:

a compressor that compresses refrigerant and discharges the compressed refrigerant;

an engine that provides a drive force to the compressor;

a radiator that cools coolant which is heated while passing through the engine;

an indoor heat exchanger that performs heat exchange between indoor air and the refrigerant, thus cooling or heating an indoor space;

an outdoor heat exchanger that condenses the refrigerant;

a four-way valve that switches a flow direction of the refrigerant in such a manner that the refrigerant discharged from the compressor flows to the outdoor heat exchanger in a cooling operation mode and flows to the indoor heat exchanger in a heating operation mode;

a hot-water storage tank that performs heat exchange between stored water and the refrigerant, and between stored water and cooling water, wherein the hot-water storage tank cools the refrigerant and the cooling water by recovering waste heat of the refrigerant and the cooling water in the cooling operation mode, and heats the refrigerant in the heating operation mode;

a branch refrigerant line that branches off from a main refrigerant line connecting the indoor heat exchanger and the outdoor heat exchanger to each other, and connects to a hot-water storage tank refrigerant line connecting the hot-water storage tank and the outdoor heat exchanger to each other;

a first three-way valve provided at a junction between the branch refrigerant line and the hot-water storage tank refrigerant line, the three-way valve being configured to selectively connect the hot-water storage tank refrigerant line and the branch refrigerant line; and an on-off valve provided on the hot-water storage tank refrigerant line between the first three-way valve and the outdoor heat exchanger, the on-off valve being configured to open the hot-water storage tank refrigerant line in the cooling operation mode and close the hot-water storage tank refrigerant line in the heating operation mode.

2. The gas heat-pump system of claim 1, further comprising:

the hot-water storage tank refrigerant line that branches off from the main refrigerant line connecting the four-way valve and the outdoor heat exchanger to each other, passes through the hot-water storage tank for the heat exchange, and then connects to the outdoor heat exchanger; and a second three-way valve that switches the flow direction of the refrigerant in such a manner that the refrigerant passing through the four-way valve flows along the main refrigerant line or the hot-water storage tank refrigerant line.

3. The gas heat-pump system of claim 2, further comprising:

a hot-water storage tank coolant line, that branches off from the main coolant line connecting the engine and the radiator to each other, passes through the hot-water storage tank for the heat exchange, and then connects to the engine; and a third three-way valve that switches a flow direction of the coolant in such a manner that the coolant passing through the engine flows along the main coolant line or the hot-water storage tank coolant line.

4. The gas heat-pump system of claim 3, wherein the hot-water storage tank coolant line is positioned above the hot-water storage tank refrigerant line within the hot-water storage tank.

5. The gas heat-pump system of claim 1, wherein in the cooling operation mode, the first three-way valve switches the flow direction of the refrigerant in such a manner that the refrigerant passes through the outdoor heat exchanger and then flows along the main refrigerant line or flows along the main refrigerant line through the branch refrigerant line.

6. The gas heat-pump system of claim 1, further comprising:

an auxiliary refrigerant line that branches off from the main refrigerant line connecting the indoor heat exchanger and the outdoor heat exchanger to each other, passes through an auxiliary heat exchanger, and then connects to the compressor;

an auxiliary expansion valve that opens and closes the auxiliary refrigerant line between the indoor heat exchanger and the auxiliary heat exchanger;

an auxiliary coolant line that branches off from the main coolant line connecting the engine and a second three-way valve, passes through the auxiliary heat exchanger, and then connects to the engine; and a third three-way valve that switches the flowing direction of the coolant in such a manner that the coolant passing through the engine flows along the main coolant line or the auxiliary coolant line.

* * * * *